US009155151B2

(12) United States Patent
Angeles

(10) Patent No.: US 9,155,151 B2
(45) Date of Patent: Oct. 6, 2015

(54) LED DIMMING CIRCUIT FOR SWITCHED DIMMING

(75) Inventor: Christian Pura Angeles, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 587 days.

(21) Appl. No.: 13/364,315

(22) Filed: Feb. 1, 2012

(65) Prior Publication Data

US 2013/0193864 A1 Aug. 1, 2013

(51) Int. Cl.
*H05B 37/02* (2006.01)
*H05B 33/08* (2006.01)

(52) U.S. Cl.
CPC ..... *H05B 33/0833* (2013.01); *H05B 33/0815* (2013.01)

(58) Field of Classification Search
None
See application file for complete search history.

(56) References Cited

U.S. PATENT DOCUMENTS

2009/0098764 A1* 4/2009 Janos et al. ..... 439/501
2011/0012530 A1* 1/2011 Zheng et al. ..... 315/294
2014/0055051 A1* 2/2014 Raval et al. ..... 315/193

* cited by examiner

*Primary Examiner* — Cassandra Cox
(74) *Attorney, Agent, or Firm* — Blakely Sokoloff Taylor & Zafman LLP

(57) ABSTRACT

A light emitting diode (LED) dimming module includes an energy storage circuit, a load interface circuit, and a switch circuit. The energy storage circuit provides a substantially continuous current in response to a converter current. The load interface circuit provides a modulated load current in response to the continuous current. The switch circuit, which is operatively coupled to the load interface circuit, switches in accordance with a duty cycle. The modulated load current is based on the duty cycle.

20 Claims, 6 Drawing Sheets

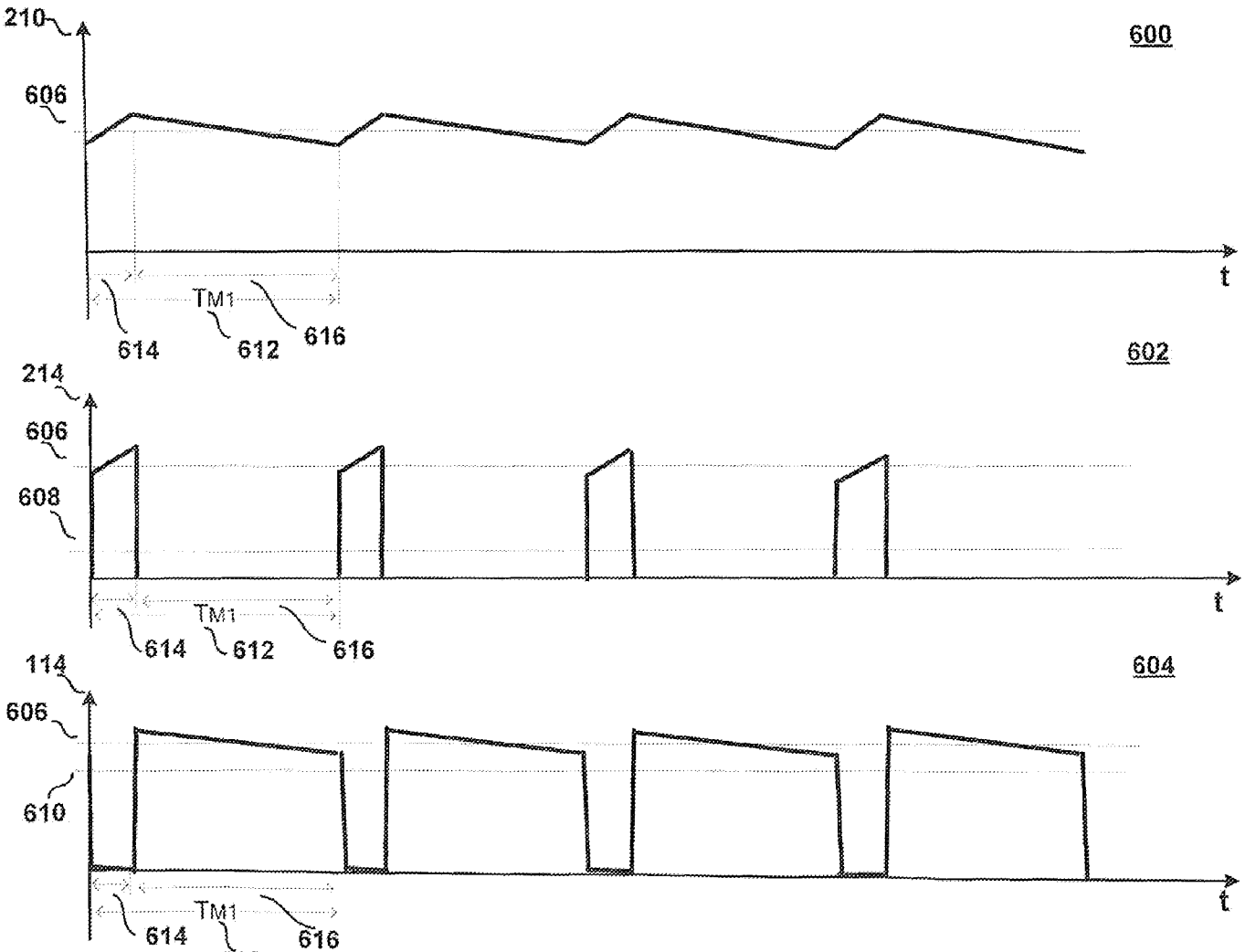
FIG. 6 waveforms at 20% Dim

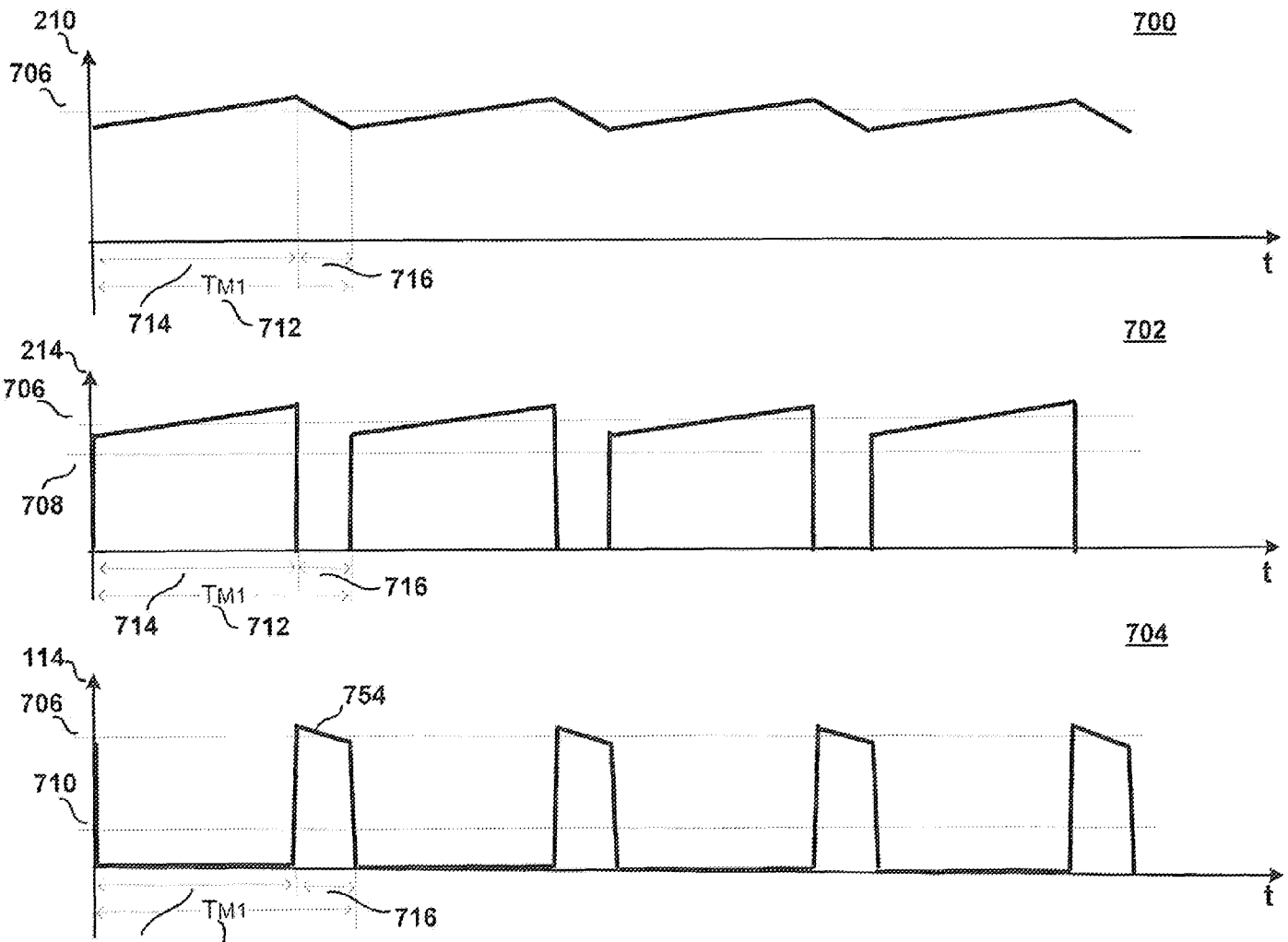
FIG. 7 waveforms at 80% Dim

LED DIMMING CIRCUIT FOR SWITCHED DIMMING

FIELD

This disclosure relates generally to power converters, and more specifically to dimming light emitting diodes coupled to power converters.

BACKGROUND

Light emitting diode (LED) lighting technology is becoming more widely used due to having a longer lifespan, fewer hazards, and increased visual appeal compared to compact fluorescent lamp (CFL) or other types of lamps. Wide applications of LEDs for lighting, televisions, monitoring panels and/or other applications increasingly requires dimming.

There are different categories of dimming for lighting applications. In one type of dimming for lighting applications, a TRIAC dimmer circuit removes a portion of the ac input voltage to limit the amount of voltage and current supplied to lamp. This is known as phase dimming because it is often convenient to designate the position of the missing voltage in terms of a fraction of the period of the ac input voltage measured in degrees. In general, the ac input voltage is a sinusoidal waveform and the period of the ac input voltage is referred to as a full line cycle. As such, half the period of the ac input voltage is referred to as a half line cycle. An entire period has 360 degrees, and a half line cycle has 180 degrees. Typically, the phase angle is a measure of how many degrees (from a reference of zero degrees) of each half line cycle the dimmer circuit removes. As such, removal of half the ac input voltage in a half line cycle by the TRIAC dimmer circuit corresponds to a phase angle of 90 degrees. In another example, removal of a quarter of the ac input voltage in a half line cycle may correspond to a phase angle of 45 degrees.

Although phase angle dimming works well with incandescent lamps that receive the altered ac line voltage directly, it typically creates problems for LED lamps driven by a switching power converter. Conventional regulated switching power converters are typically designed to ignore distortions of the ac input voltage and deliver a constant regulated output until a low input voltage causes them to shut off. As such, conventional regulated switching power converters cannot dim LED lamps. Unless a power converter for an LED lamp is specially designed to recognize and respond to the voltage from a TRIAC dimmer circuit in a desirable way, a TRIAC dimmer can produce unacceptable results such as flickering of the LED lamp.

Another difficulty in using TRIAC dimming circuits with LED lamps comes from a characteristic of the TRIAC itself. A TRIAC is a semiconductor component that behaves as a controlled ac switch. In other words, it behaves as an open switch to an ac voltage until it receives a trigger signal at a control terminal, which causes the switch to close. The switch remains closed as long as the current through the switch is above a value referred to as the holding current. Most incandescent lamps use more than enough current from the ac power source to allow reliable and consistent operation of a TRIAC. However, the low current used by efficient power converters to drive LED lamps may not provide enough current to keep a TRIAC conducting for the expected portion of the ac line period. Therefore, conventional power converter controller designs rely on a dummy load, sometimes called a bleeder circuit, to take enough extra current from the input of the power converter to keep the TRIAC conducting.

In addition, the sharply increasing input voltage when the TRIAC fires during each half line cycle causes inrush input current ringing which may reverse several times during the half line cycle. During these current reversals, the TRIAC may prematurely turn off and cause flickering in the LED lamp. A series resistor damper may then be utilized to slow down the charging of the input capacitor, and dampen the input current ringing and prevent voltage overshoot of the input capacitor. In general, the damper circuit is external from the integrated circuit of the power converter controller and is implemented with a resistor coupled at the input of the power converter. However, use of the damper resistor and the dummy load degrades the overall efficiency of the system.

Some LED drivers use analog dimming to adjust LED brightness levels. Analog dimming adjusts brightness by changing forward current of the LEDs. For example, if an LED is at full brightness with 20 mA of forward current, then 25% brightness can be achieved by driving the LED with 5 mA of forward current. While this dimming scheme works well for lower end displays, the color of the LEDs shifts with changes in forward current, which is undesirable.

Other LED drivers use digital dimming such a pulse width modulation (PWM) to periodically switch between a determined current (e.g., logical high) and a substantially zero current (e.g., logical low) flow through the LED. This technique can adjust LED brightness while maintaining color quality. However, this technique requires a high frequency to prevent flickering that may be detectable by human eyes and/or cause digital noise, which is undesirable.

As such, a method and apparatus is desirable to overcome one or more of the aforementioned disadvantages.

BRIEF DESCRIPTION OF THE DRAWINGS

The present disclosure is illustrated by way of example and is not limited by the accompanying figures, in which like references indicate similar elements. Elements in the figures are illustrated for simplicity and clarity and have not necessarily been drawn to scale.

FIG. 6 depicts example timing diagrams of various currents associated with the LED dimmer module at 20% dimming according to the present disclosure.

FIG. 7 depicts example timing diagrams of various currents associated with the LED dimmer module at 80% dimming according to the present disclosure.

DETAILED DESCRIPTION

Figure 1:
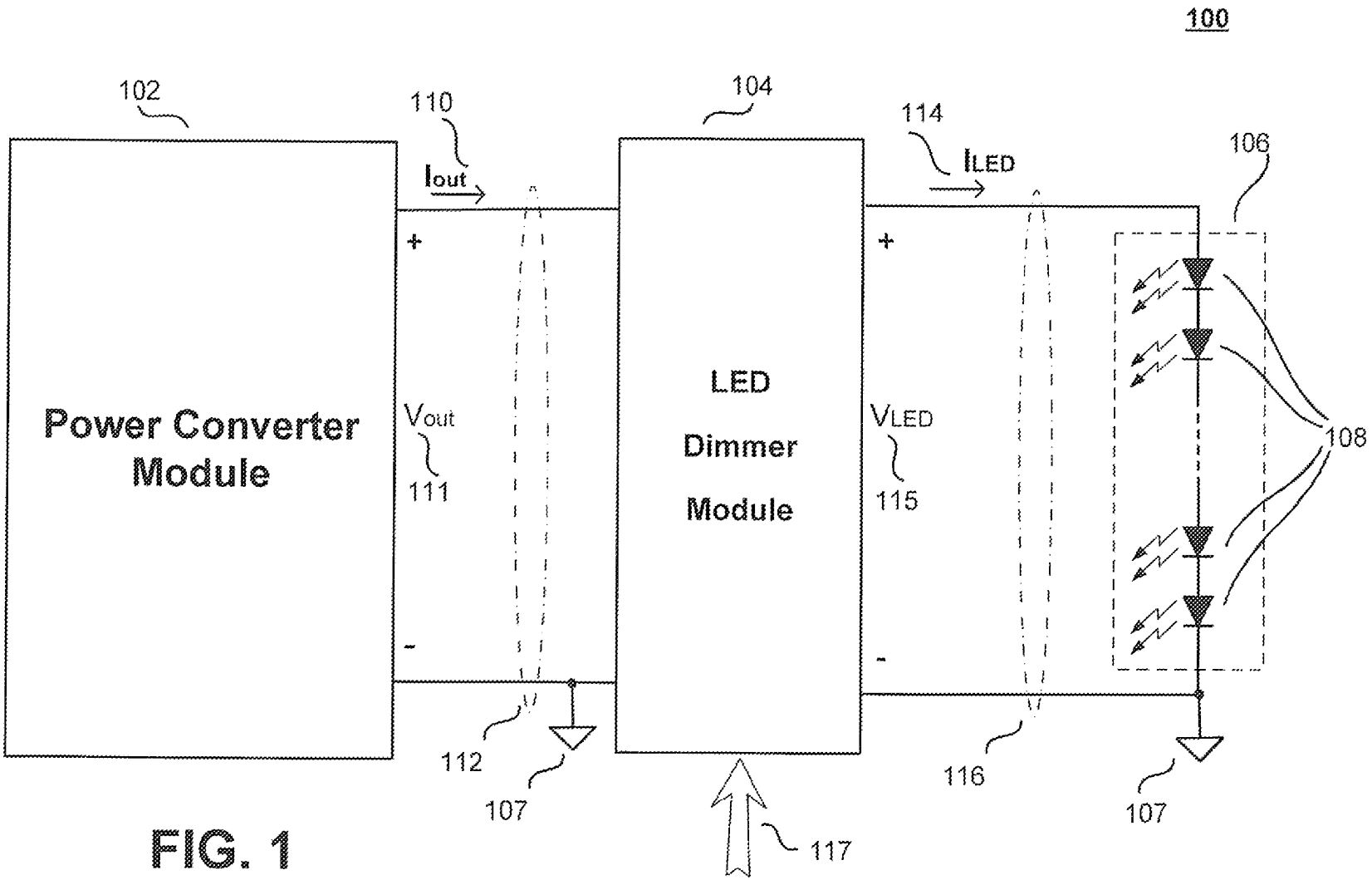
FIG. 1 is a functional block diagram of a light emitting diode (LED) dimming system according to the present disclosure.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

As used herein, the term "circuit" and/or "module" can include an electronic circuit, one or more processors (e.g., shared, dedicated, or group of processors such as but not limited to microprocessors, digital signal processors, or central processing units) and memory that execute one or more software or firmware programs, combinational logic circuits, an application specific integrated circuit, and/or other suitable components that provide the described functionality. Additionally, as will be appreciated by those of ordinary skill in the art, one or more circuits can be combined in an integrated circuit if desired. Furthermore, the term "signal" may refer to one or more currents, one or more voltages, or a data signal.

In one example, a light emitting diode (LED) dimmer module includes an energy storage circuit, a load interface circuit, and a switch circuit. The energy storage circuit provides a substantially continuous current in response to a converter current. The load interface circuit provides a modulated load current in response to the continuous current. The switch circuit, which is operatively coupled to the load interface circuit, switches in accordance with a duty cycle. The modulated load current is based on the duty cycle.

Among other advantages, the LED dimmer module maintains a substantially constant and continuous current draw from a power converter while an LED load is modulated (e.g., pulse width modulated), which reduces (and in some cases eliminates) audible switching noise. In addition, the modulated load current does not exhibit current overshoot to the LED load. Furthermore, the LED dimming module has a minimal (or in some cases no) effect on power factor correction of the power converter. Other advantages will be recognized by those of ordinary skill in the art.

Referring now to FIG. 1, a functional block diagram of a light emitting diode (LED) dimming system 100 is depicted. The LED dimming system 100 includes a power converter module 102, an LED dimmer module 104, and an LED module 106. As shown, in this example, the LED dimmer module 104 is disposed between the power converter module 102 and the LED module 106. Additionally, in this example, the power converter 102, the LED dimmer module 104, and the LED module 106 are coupled to an input return 107 (e.g., ground). The power converter module 102 can be any suitable power converter known in the art. For example, the power converter module 102 can be a primary non-ideal contestant current power converter, an AC-DC power converter, a DC-DC power converter, an isolated power converter, a non-isolated power converter, and/or other suitable power converter. The LED module 106 can comprise one or more LEDs 108. In one example, the LEDs 108 can be configured as an LED string, an LED matrix, and/or other suitable configuration.

The power converter module 102 provides a power converter current 110 and a power converter voltage Vout 111 in response to a power source (not shown) such as an AC or DC power source. In one example, the power converter current 110 and the power converter voltage 111 can be provided via a power converter port 112. The power converter current 110 is a substantially constant current. In response to the power converter current 110, the LED dimmer module 104 provides a modulated load current 114 and modulated load voltage 115. The modulated load current 114 and modulated load voltage 115 are also based on, and in response to, a dimming control signal 117. The dimming control signal 117 can be received from any suitable dimming adjustment module such as, for example, a wall or other suitable dimmer module that a user can interact with to control brightness of the LED module 106. In one example, the modulated load current 114 can have a switching speed greater than a few kilo Hertz (kHz), such as for example 100 kHz, so that a human eye cannot detect a flicker in the LED module 106 caused by it turning on and off in response to the modulated current 114. In some embodiments, the switching speed can be increased up to 100 kHz or more.

In one example, the modulated load current 114 and the modulated load voltage 115 can be provided via a load port 116. The modulated load current 114 can be a pulse width modulated current and/or other suitable modulated current. Likewise, the modulated load voltage 115 can be pulse width modulated and/or other suitable modulation. The LED module 106 provides light via the LEDs 108 in response to the modulated load current 114. The brightness of the light provided by the LEDs 108 is based on a duty cycle of the modulated load current 114. For example, the more the modulated load current 114 is "on" (e.g., switch circuit is open and current is passing through the LED load), the brighter the light provided will be. Conversely, the more the modulated load current 114 is "off" (e.g., switch circuit is closed to pass the current towards the return line and substantially no current is passing through the LED load), the dimmer the light provided will be.

In one example, the modulated load voltage 115 can be based on a ratio of the power converter voltage 111 and the duty cycle. More specifically, the modulated load voltage 115 can be characterized by the following equation: $V_{LED}=(V_{out})/(1-D)$, where $V_{LED}$ is the modulated load voltage 115, $V_{OUT}$ is the power converter voltage 111, and D is the duty cycle. In other words, the level of power converter output voltage $V_{OUT}$ 111 changes based on a product of an average level of modulated load voltage $V_{LED}$ 115 and the duty cycle of switch circuit 206. More specifically, the power converter output voltage $V_{OUT}$ 111 at each dimming level can be characterized by the following equation: $V_{out}=V_{LED}\cdot(1-D)$, where $V_{out}$ is the power converter output voltage 111, $V_{LED}$ is the modulated load voltage 115 and D is the duty cycle of switch circuit 206 required for that dimming level.

Figure 2:
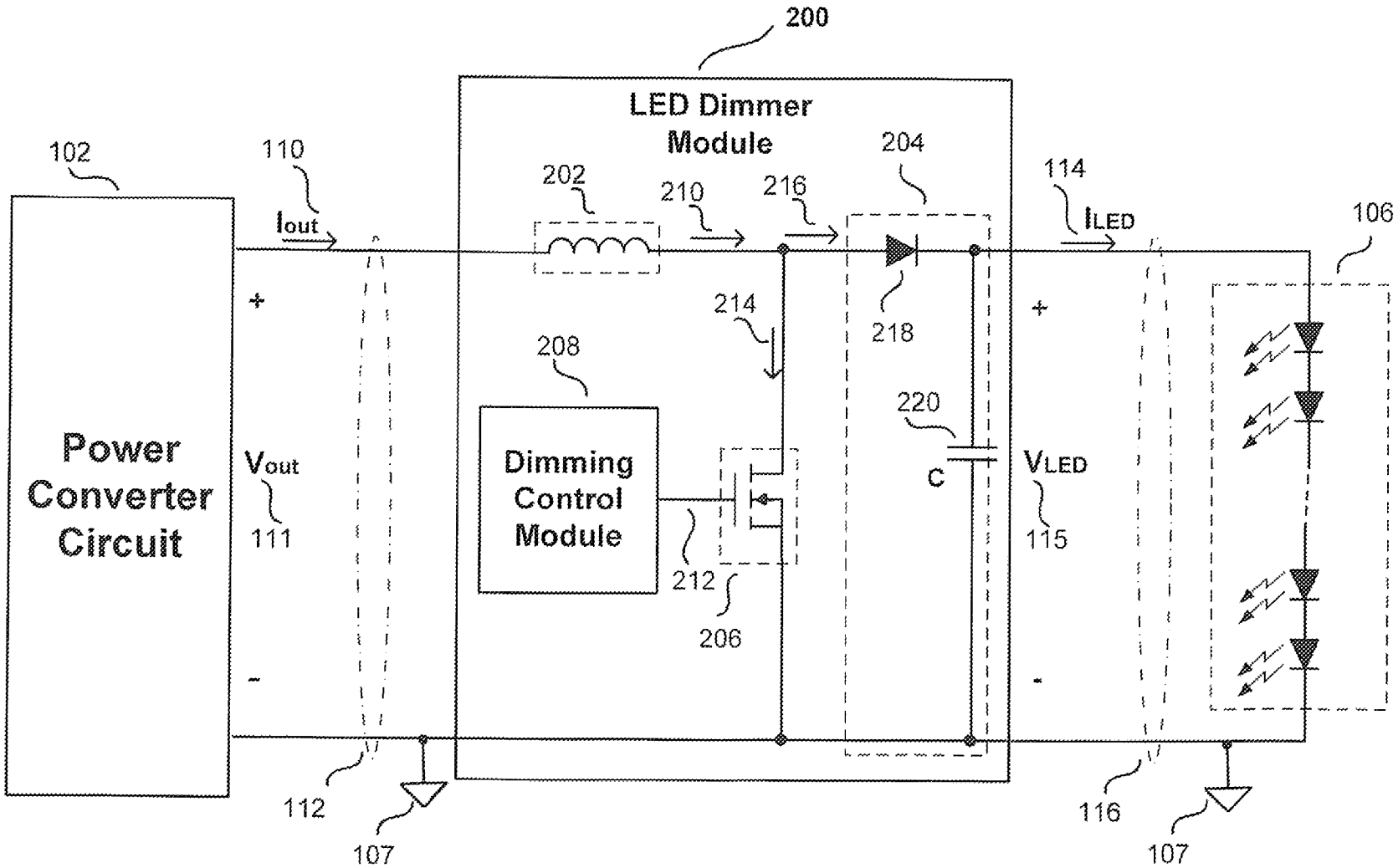
FIG. 2 is a functional block diagram of a LED dimmer module of the LED dimming system according to the present disclosure.

Referring now to FIG. 2, an example of an LED dimmer module 200 is depicted. The LED dimmer module 200 is one possible implementation of the LED dimmer module 104 of FIG. 1 although other implementations are possible. In this example, the LED dimmer module 200 includes an energy storage circuit 202, a load interface circuit 204, a switch circuit 206, and a dimming control module 208 substantially configured as shown.

The energy storage circuit 202 provides a substantially continuous current 210 in response to the power converter current 110. In one example, the energy storage circuit 202 can comprise an inductor, although other embodiments are contemplated. In one embodiment, the inductor can have an inductance of 1 mili Henry (mH) or other suitable value.

The dimming control module 208 provides a switch control signal 212 in response to the dimming control signal 117. The switch control signal 212 is a modulated signal, such as a pulse width modulated signal for example, that is based on the dimming control signal 117. More specifically, in one example, the switch control signal 212 can be "on" for half a cycle and "off" for half a cycle when the dimming control signal 117 indicates the brightness of the LED module 106 to be at or about 50% brightness.

In response to the switch control signal 212, the switch circuit 206 opens and closes based on the duty cycle of the switch control signal 212. As such, switch current 214 flows though the switch circuit 206 when it is closed and substantially does not flow through the switch circuit 206 when it is open. In one example, the switch circuit 206 can comprise a transistor such as, for example, a MOSFET, a BJT, a JFET, and/or other suitable transistor.

The load interface circuit 204 provides a substantially spike and oscillation free modulated load current 114 in response to a modulated current 216. The modulated current 216 is based on the duty cycle of the dimming control module 208. More specifically, in this example, the modulated current 216 is based on a difference between the substantially continuous current 210 and the switch current 214. As such, when the switch circuit 206 is closed, the modulated current 216 is substantially zero and when the switch circuit 206 is open, the modulated current 216 is substantially equivalent to the determined level of continuous current 210.

In this example, the load interface circuit 204 includes a diode 218 and a capacitor 220 substantially configured as shown. The diode 218 can be any suitable low reverse recovery current diode and/or any suitable fast recovery diode such as, for example, a Schottky and/or other suitable diode. In one example, the capacitor 220 can have a value of 22 nano Farad (nF) or other suitable value. The load interface circuit 204 also acts as a current snubber to substantially eliminate or reduce current spikes or oscillation at switching edges. The diode 218 prevents current from flowing away from the LED module 106 and back into the LED dimmer module 200. As such, an improved dimming can be achieved and issues associated with prior art dimming methodologies such as flickering can be substantially eliminated or reduced.

The LED module 106 provides light in response to the modulated load current 114. As noted above, the modulated load current 114 can be pulse width modulated. As such, the brightness of the light provided by the LED module 106 is based on the duty cycle of the switch control signal 212. As noted above, the more the modulated load current 106 is "on" (e.g., substantially greater than zero), the brighter the light provided by the LED module 106 will be. Likewise, the more the modulated load current 106 is "off" (e.g., substantially zero), the less bright the light provided by the LED module 106 will be.

Figure 3:
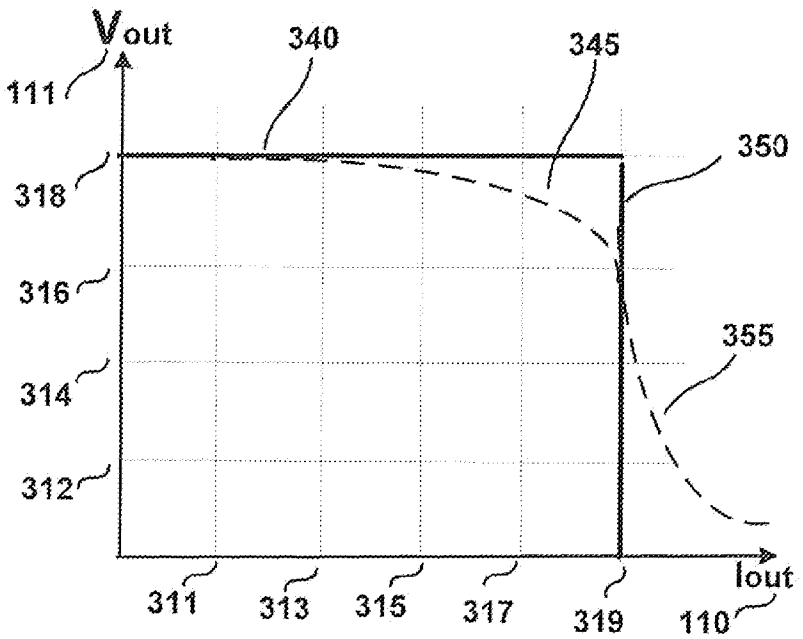
FIG. 3 is an example graph depicting a relationship between a power converter current and a power converter voltage according to the present disclosure.

Referring now to FIG. 3, an example graph depicting the relationship between the power converter current 110 and the power converter voltage 111 is generally identified at 300. The lines 340 and 345 are depicted for the ideal constant voltage mode of operation and constant current mode of operation, respectively, and lines 350 and 355 depict a non-ideal constant voltage mode of operation and a non-ideal constant current mode of operation respectively. As shown, in a non-ideal power converter, via lines 345 and 355, in a constant voltage mode of operation the power converter output voltage 111 may experience a slight drop with respect to the regulated ideal constant voltage 340 and in the constant current mode of operation the power converter output current 110 may deviate slightly from the regulated ideal constant current 350. In a constant voltage mode of operation, increasing the output current from 311 to 313, 315, 317 and eventually to a maximum value of 319, drop the output voltage 111 $V_{out}$ from 318 to 316. Similarly, in a constant current mode of operation, reducing the output voltage from 318 to 316, 314 and 312, makes the output current 110 $I_{out}$ not constant at 319 and gradually increases. As such, by utilizing the LED dimmer module 104, 200, cascaded at the output of a non-ideal (loosely regulated) power converter 102, a well-controlled modulated load current 114 for an improved quality adjustable dimming of LED module 106 can be achieved.

Figure 4:
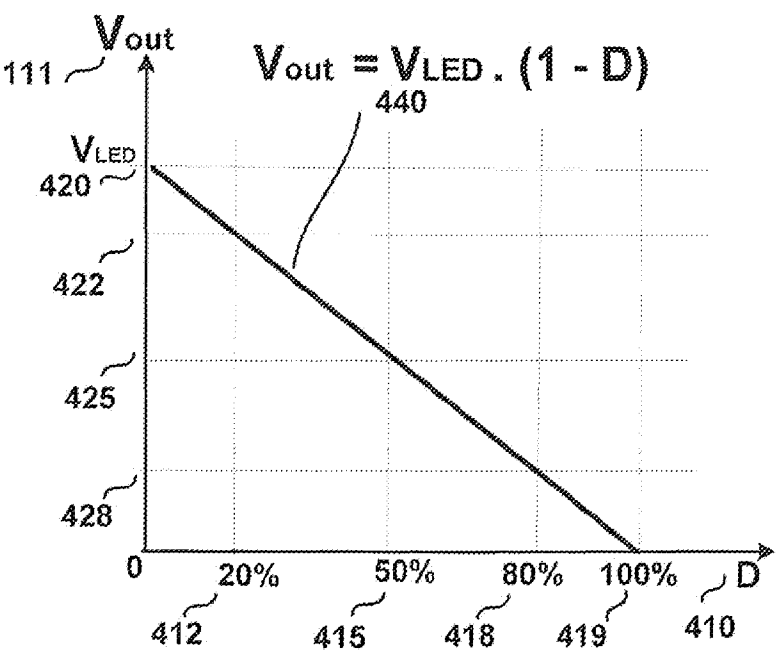
FIG. 4 is an example graph depicting a relationship between a modulated load voltage and a duty cycle of the LED dimmer module according to the present disclosure.

Referring now to FIG. 4, an example graph depicting the relationship between the power converter output voltage 111 $V_{out}$ and the duty cycle of the switch control signal 212 is generally identified at 400. When the switch circuit 206 is closed (e.g., during on-time of switch/duty cycle), voltage across LED module 106 is substantially zero (e.g., logical low) and when switch circuit 206 opens (off-time of switch), voltage across the LED module 106 increases to a determined value (e.g., logical high). In one example, the level of voltage across the LED module 106 can be defined by the number and structure of LEDs 108 of the LED module 106.

The relationship between the voltage at the power converter port 112 to the LED dimmer module 106 and the pulse on-time voltage level at the load port 116 of the LED dimmer module 200 can be defined by the equation $V_{LED}=(V_{out})/(1-D)$, where $V_{LED}$ is the level of pulsating voltage across the LED module, $V_{out}$ is the power converter output voltage 111 (or the continuous voltage level at port 112), and D is the duty cycle of the switch control signal 212. As noted above, this relationship can also be presented by the relationship of: $V_{out}=(V_{LED}).(1-D)$, which is depicted in FIG. 4 as $V_{out}$ 111 Versus D 410. The intersection of graph with vertical axis $V_{out}$ 111 at zero duty cycle (no dimming) presents $V_{LED}$. By increasing duty cycle of the switch control signal 212 to 20%, 412 (which refers to 20% dimming), to 50% 415 (which refers to 50% dimming), and to 80% 418 (which refers to 80% dimming) the power converter output voltage 111 $V_{out}$ drops to 80% of $V_{LED}$, to 50% of $V_{LED}$, and to 20% of $V_{LED}$, respectively. In one example, the 100% duty cycle 419 can be referred to a short circuit across the LED module 106 and light shutdown.

Figure 5:
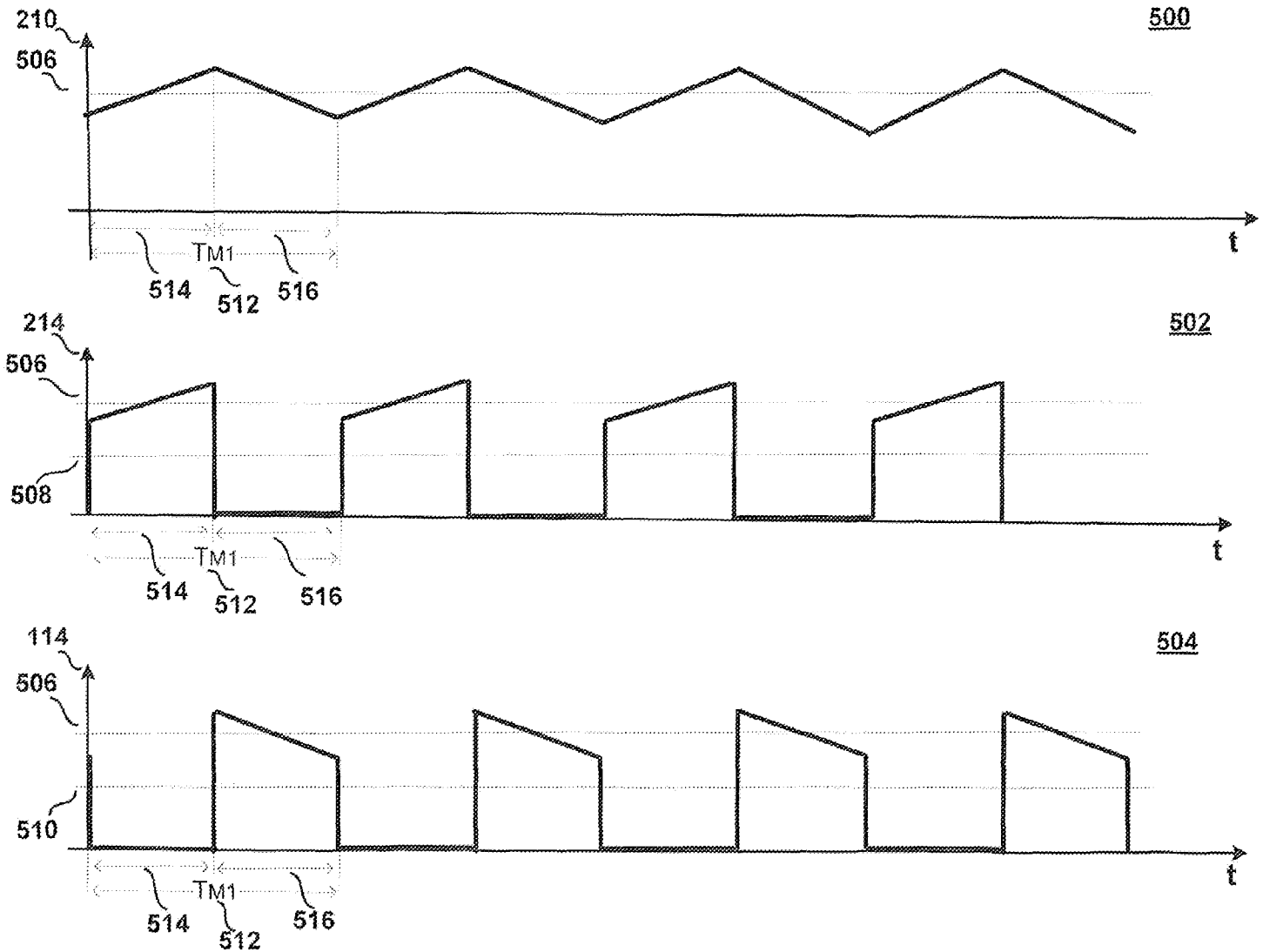
FIG. 5 depicts example timing diagrams of various currents associated with the LED dimmer module at 50% dimming according to the present disclosure.

As shown, while the level of pulsating voltage at output port of LED dimmer module 200 and across the LED module is kept substantially constant during the on-time of pulsating voltage $V_{LED}$, the input voltage to the LED dimmer module 200 (e.g., the power converter output voltage) linearly drops by increasing duty cycle of switch circuit 206 and increased level of dimming Referring now to FIG. 5, example timing diagrams of various currents according to the present disclosure are depicted. More specifically, a timing diagram of the continuous current 210 (in FIG. 2) is generally identified at 500, a timing diagram of the switch current 214 (in FIG. 2) is generally identified at 502, and a timing diagram of the modulated load current 114 (in FIG. 1 and FIG. 2) is generally identified at 504. As shown, an average value of the continuous current is shown at 506 in each timing diagram. In addition, an average value of the switch current 214 is shown at 508 and an average value of the modulated load current 114 is shown at 510. In this example, the duty cycle of the switch control signal 212 is set to a half cycle "on" and a half cycle "off." As shown, one complete switching cycle corresponds with time 512 and times 514 and 516 each correspond to a half switching cycle. As such, the LED module 106 provides approximately 50% of its maximum brightness value for 50% dimming. Although a 50% duty cycle is shown in this example, it is recognized that other duty cycles can be used in accordance with a desired dimming value. For example as will be described in FIG. 7, if it is desired to dim the LED module 106 by 80%, then the modulated load current can be "on" (passing the current) 20% of the time and the switch circuit can be closed or in "on" position (passing the current) 80% of the time. In other words, a duty cycle of 80% for the switch circuit is required for the LED module dimming of 80%.

During time 514, the continuous current 210 and the switch current 214 rise having an increasing slope due to the switch circuit 206 being closed and conducting current through the energy storage circuit 202. The average current through the switch circuit due to the duty cycle of switch circuit is depicted as 508. Additionally, during time 514, the modulated load current 114 is substantially zero. This is due to the current following the path of least resistance and passing through the switch circuit 206 rather than the LED module 106.

During time 516, the continuous current 210 and the switch current 214 decrease having a decreasing slope due to the switch circuit 206 being open and substantially not conducting current (e.g., zero). Additionally, during time 516, the modulated load current 114 initially rises up and decays over the duration of time 516 thus having a decreasing slope and energy stored in the energy storage circuit 202 is being discharged to the LED module. As such, during time 516, the LED module 106 receives the current and the brightness of light provided by the LED module corresponds to the average value of current 510 through the LED module.

Referring now to FIG. 6, another example timing diagrams of various currents for 20% dimming of LED module according to the present disclosure are depicted. More specifically, a timing diagram of the continuous current 210 is generally identified at 600, a timing diagram of the switch current 214 is generally identified at 602, and a timing diagram of the modulated load current 114 is generally identified at 604. As shown, an average value of the continuous current is shown at 606 in each timing diagram. In addition, an average value of the switch current 214 is shown at 608 and an average value of the modulated load current 114 is shown at 610. In this example, the duty cycle of the switch circuit is set to 20% (20% of the cycle "on" and 80% of the cycle "off"). As such, the LED module 106 provides approximately 80% of its maximum brightness value for 20% dimming. Although a 20% duty cycle of the switch circuit is shown in this example, it is recognized that any other duty cycles can be used in accordance with a desired dimming value.

During time 614, the continuous current 210 and the switch current 214 rise having an increasing slope due to the switch circuit 206 being closed and conducting current through the energy storage circuit 202. The average current through the switch circuit due to the duty cycle of switch circuit is depicted as 608. Additionally, during time 614, the modulated load current 114 is substantially zero. This is due to the current following the path of least resistance and passing through the switch circuit 206 rather than the LED module 106.

During time 616, the continuous current 210 and the switch current 214 decrease having a decreasing slope due to the switch circuit 206 being open and substantially not conducting current (e.g., zero). Additionally, during time 616, the modulated load current 114 initially rises up and decays over the duration of time 616 thus having a decreasing slope and energy stored in the energy storage circuit 202 is being discharged to the LED module. As such, during time 616, the LED module 106 receives the current and. brightness of light provided by the LED module corresponds to the average value of current 610 through the LED module.

Referring now to FIG. 7, yet another example timing diagrams of various currents for 20% dimming of LED module according to the present disclosure are depicted. More specifically, a timing diagram of the continuous current 210 is generally identified at 700, a timing diagram of the switch current 214 is generally identified at 702, and a timing diagram of the modulated load current 114 is generally identified at 704. As shown, an average value of the continuous current is shown at 706 in each timing diagram. In addition, an average value of the switch current 214 is shown at 708 and an average value of the modulated load current 114 is shown at 710. In this example, the duty cycle of switch circuit is set to 80% of the cycle (80% of the cycle "on" and 20% of the cycle "off"). As such, the LED module 106 provides approximately 20% of its maximum brightness value for 80% dimming. Although a 80% duty cycle of the switch circuit is shown in this example, it is recognized that any other duty cycles can be used in accordance with a desired dimming value.

During time 714, the continuous current 210 and the switch current 214 rise having an increasing slope due to the switch circuit 206 being closed and conducting current through the energy storage circuit 202. The average current through the switch circuit due to the duty cycle of switch circuit is depicted as 708. Additionally, during time 714, the modulated load current 114 is substantially zero. This is due to the current following the path of least resistance and passing through the switch circuit 206 rather than the LED module 106.

During time 716, the continuous current 210 and the switch current 214 decrease having a decreasing slope due to the switch circuit 206 being open and substantially not conducting current (e.g., zero). Additionally, during time 716, the modulated load current 114 initially rises up and decays over the duration of time 716 thus having a decreasing slope and energy stored in the energy storage circuit 202 is being discharged to the LED module. As such, during time 716, the LED module 106 receives the current and brightness of light provided by the LED module corresponds to the average value of current 610 through the LED module.

As noted above, among other advantages, the LED dimming module maintains a substantially constant and continuous current draw from a power converter while an LED load is modulated (e.g., pulse width modulated), which reduces (and in some cases eliminates) audible switching noise. In addition, the modulated load current does not exhibit any overshoot spikes or oscillation to the LED load. Furthermore, the LED dimming module has a minimal (or in some case no) effect on power factor correction of the power converter. Other advantages will be recognized by those of ordinary skill in the art.

Although the disclosure is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

What is claimed is:

1. A light emitting diode dimming module comprising:

an energy storage circuit coupled to receive a converter current from a converter circuit to provide a substantially continuous current;

a switch circuit, coupled to the energy storage circuit, wherein the switch circuit is coupled to draw a switch current from the substantially continuous current in response to a switch control signal having a duty cycle; and a load interface circuit coupled to the energy storage circuit and to the switch circuit, wherein the load interface circuit is coupled to receive a modulated current from the energy storage circuit responsive to a difference between the substantially continuous current and the switch current to provide a modulated load current to a load coupled to the load interface circuit.

2. The light emitting diode dimming module of claim 1 wherein the modulated load current is a pulse width modulated current.

3. The light emitting diode dimming module of claim 1 wherein the load interface circuit is coupled to provide a light emitting diode voltage to the load in response to an energy storage voltage, wherein the energy storage voltage is based on a converter voltage from the converter circuit.

4. The light emitting diode dimming module of claim 3 wherein the light emitting diode voltage is based on a ratio of the converter voltage and the duty cycle.

5. The light emitting diode dimming module of claim 1 further comprising a modulation control circuit coupled to generate the switch control signal to switch the switch circuit based on the duty cycle.

6. The light emitting diode dimming module of claim 5 wherein the modulation control circuit is a pulse width modulation control circuit.

7. The light emitting diode dimming module of claim 1 wherein:

the energy storage circuit comprises an inductance circuit, and wherein the load interface circuit comprises:

a diode circuit coupled to the inductance circuit; and a capacitance circuit coupled to the diode circuit.

8. The light emitting diode dimming module of claim 1 wherein the switch circuit comprises a transistor circuit.

9. An apparatus, comprising:

a plurality of light emitting diodes coupled to provide light in response to a modulated load current; and a light emitting diode dimmer module coupled to provide the modulated load current in response to a converter current, the light emitting diode dimmer module comprising:

an energy storage circuit coupled to receive the converter current from a converter circuit to provide a substantially continuous current;

a switch circuit coupled to the energy storage circuit, wherein the switch circuit is coupled to draw a switch current from the substantially continuous current in response to a switch control signal having a duty cycle; and a load interface circuit coupled to the energy storage circuit and to the switch circuit, wherein the load interface circuit is coupled to receive a modulated current from the energy storage circuit responsive to a difference between the substantially continuous current and the switch current to provide the modulated load current to the plurality of light emitting diodes.

10. The apparatus of claim 9 wherein an intensity of the light varies in accordance with the duty cycle.

11. The apparatus of claim 9 wherein the modulated load current is a pulse width modulated current.

12. The apparatus of claim 9 wherein the load interface circuit is coupled to provide a light emitting diode voltage to the plurality of light emitting diodes in response to an energy storage voltage, wherein the energy storage voltage is based on a converter voltage from the converter circuit.

13. The apparatus of claim 12 wherein the light emitting diode voltage is based on a ratio of the converter voltage and the duty cycle.

14. The apparatus of claim 9 wherein the light emitting diode dimmer module further comprises a modulation control circuit coupled to generate the control signal to switch the switch circuit based on the duty cycle.

15. The apparatus of claim 14 wherein the modulation control circuit is a pulse width modulated control circuit.

16. The apparatus of claim 9 wherein:

the energy storage circuit comprises an inductance circuit and wherein the load interface circuit comprises:

a diode circuit coupled to the inductance circuit; and a capacitance circuit coupled to the diode circuit.

17. The apparatus of claim 9 wherein the switch circuit comprises a transistor circuit.

18. An apparatus, comprising:

a plurality of light emitting diodes coupled to provide light in response to a modulated load current; and a light emitting diode dimming circuit coupled to provide the modulated load current in response to a converter current, the light emitting diode dimming circuit comprising:

an energy storage circuit coupled to receive the converter current to provide a substantially continuous current, the energy storage circuit comprising an inductance circuit;

a switch circuit coupled to the energy storage circuit, wherein the switch circuit is coupled to draw a switch current from the substantially continuous current in response to a switch control signal having a duty cycle, and wherein an intensity of the light varies in accordance with the duty cycle; and a load interface circuit coupled to the energy storage circuit and to the switch circuit, wherein the load interface circuit is coupled to receive a modulated current from the energy storage circuit responsive to a difference between the substantially continuous current and the switch current to provide the modulated load current to the plurality of light emitting diodes, the load interface circuit comprising a diode circuit coupled to the inductance circuit, and a capacitance circuit coupled to the diode circuit.

19. The apparatus of claim 18 wherein the light emitting diode dimming circuit further comprises a dimming control module coupled to generate the control signal to switch the switch circuit based on the duty cycle.

20. The apparatus of claim 18 comprising a power converter circuit coupled to provide the converter current in response to a power source.

* * * * *